United States Patent [19]

Nakayama et al.

[11] 4,101,250

[45] Jul. 18, 1978

[54] SWASH PLATE TYPE COMPRESSOR

[75] Inventors: Shozo Nakayama, Kariya; Masayuki Kurahashi, Nagoya; Nobuyuki Araki, Kariya, all of Japan

[73] Assignee: Kabushiki Kaisha Toyoda Jidoshokki Seisakusho, Kariya, Japan

[21] Appl. No.: 755,480

[22] Filed: Dec. 29, 1976

[30] Foreign Application Priority Data

Dec. 29, 1975 [JP] Japan ..... 50-176446[U]

[51] Int. Cl.[2] ..... F04B 1/12; F04B 27/08

[52] U.S. Cl. ..... 417/269

[58] Field of Search ..... 417/269–272, 417/454, 222; 74/60

[56] References Cited

U.S. PATENT DOCUMENTS

| | | | |
|---|---|---|---|
| 1,781,130 | 11/1930 | Shaff | 74/60 |
| 2,380,574 | 7/1945 | Beeh et al. | 417/269 X |
| 3,057,545 | 10/1962 | Ranson et al. | 417/269 |
| 3,749,523 | 7/1973 | Wahl | 417/269 |
| 3,904,320 | 9/1975 | Kishi et al. | 417/269 |
| 3,955,899 | 5/1976 | Nakayama et al. | 417/269 |

*Primary Examiner*—William L. Freeh
*Assistant Examiner*—Edward Look
*Attorney, Agent, or Firm*—Dennison, Dennison, Meserole & Pollack

[57] ABSTRACT

A swash plate type compressor adapted for use in an automotive cooling system is disclosed. A cylinder block, which forms a principal part of the compressor and is axially divided into two portions, has at least four bores arranged at equal distances along the circumference thereof. A clamping bolt for uniting all principal members of the compressor extends through a hole provided through a narrow interzone lying between each two adjacent bores. The through hole has a diameter considerably greater than that of the clamping bolt. The space between the inner surface of the hole and the outer surface of the bolt serves as a passage through which a low pressure refrigerant gas flows, and this helps simplification in construction and improvement in capacity of the swash plate type compressor.

5 Claims, 4 Drawing Figures

SWASH PLATE TYPE COMPRESSOR

BACKGROUND OF THE INVENTION

This invention relates to a refrigerant gas compressor having a swash plate adapted for use in an automotive cooling system, particularly to an improvement in construction of gas passages formed within the compressor body.

Conventionally, a swash plate type compressor has a cylinder block which is axially dividable into two portions between which there is formed a swash plate chamber in which a swash plate rotates. Each of the two cylinder block portions is provided with at most three bores at equal distances along the circumference thereof. A low pressure gas passage is made in an interzone between two adjacent bores and a high pressure gas passage is made in another interzone between another two adjacent bores. A plurality of clamping bolts for uniting all principal members of the compressor in its axial direction extend through flange portions or projections radially outwardly extending from the both ends of the substantially cylindrical compressor body. Because of the presence of such projections, the general diameter of the compressor becomes greater, accordingly it is inconvenient to arrange the compressor within a narrow engine room of a motor vehicle.

In recent years, it has been tried to make the general diameter of the compressor body smaller to some extent by passing the clamping bolts through interspaces between two adjacent bores and by omitting the above-mentioned projections. However, due to the ever-increasing requirement for the high performance of motor vehicles, the space for installing various accessories including the refrigerant compressor is more restricted. Accordingly, it is required to make the compressor much smaller and to further improve its capacity. But, if the compressor body is made smaller in such a way as mentioned hereinbefore, it will be difficult to insure enough space for providing the refrigerant passages as well as the through holes for clamping bolts. In addition, if the number of bores is increased for the purpose of improving the capacity of the compressor, the space between two adjacent bores becomes much narrower. Consequently, it will be more difficult to arrange the refrigerant passages and the through holes for the clamping bolts. Owing to these structural problems, the above-mentioned requirements have not been fulfilled as yet.

SUMMARY OF THE INVENTION

This invention was completed to overcome the foregoing problems relative to the customary swash plate type compressor.

It is accordingly a primary object of this invention to provide a small-sized refrigerant gas compressor of high capacity.

It is a special object of this invention to provide a swash plate type compressor which may conveniently be arranged in a narrow engine room of a motor vehicle for the purpose of air-conditioning.

It is a fundamental object of this invention to provide a swash plate type compressor having refrigerant gas passages properly scattered to maintain the body thereof at a low temperature, to more efficiently introduce the refrigerant gas therewithin and to improve the gas compressibility.

It is another object of this invention to provide a swash plate type compressor into which refrigerant gas is introduced through a single inlet port and from which the gas is discharged through a single outlet port.

It is a further object of this invention to achieve good lubrication between the various parts of a swash plate chamber by allowing the refrigerant gas containing lubricating oil in the form of mist to pass through the swash plate type compressor.

It is a still further object of this invention to make it easier to form the cylinder block with holes into which clamping bolts are inserted.

According to this invention, there is provided a swash plate type compressor comprising a cylinder block consisting of a front portion and a rear portion, each of the cylinder block portions being provided with a plurality of bores arranged at equal distances along its circumference; a swash plate chamber formed in the cylinder block in which a swash plate is rotatably fixed to a longitudinal shaft, the swash plate chamber being connected to a refrigerant gas suction port provided at the middle portion of the cylinder block; a plurality of duplex head pistons which axially reciprocate in engagement with the swash plate in the swash plate chamber, the duplex head pistons being fitted in the bores of the cylinder block; and a front and a rear housing attached to the front and the rear ends of the cylinder block through a front and a rear valve plate, respectively, each of the front and rear housings having a low pressure gas chamber as well as a high pressure gas chamber which may communicate with the bores of the cylinder block, wherein between each two adjacent bores of the cylinder block there is provided a through hole into which a clamping bolt is inserted, the diameter of the through hole being made greater than that of the clamping bolt in order to provide a space which serves as a refrigerant gas passage, at least one of the through holes being fluidly connected with the front and rear high pressure gas chambers formed in the front and rear housings and a refrigerant gas outlet port, and the other through holes being fluidly connected with the centrally located swash plate chamber and the low pressure gas chambers of both housing.

The above and further objects and novel features of this invention will more fully appear from the following detailed description when the same is read in connection with the accompanying drawings. It is to be understood, however, that the drawings are for the purpose of illustration only and are not intended as a definition of the limits of this invention.

DESCRIPTION OF THE PREFERRED EMBODIMENT

Figure 1:
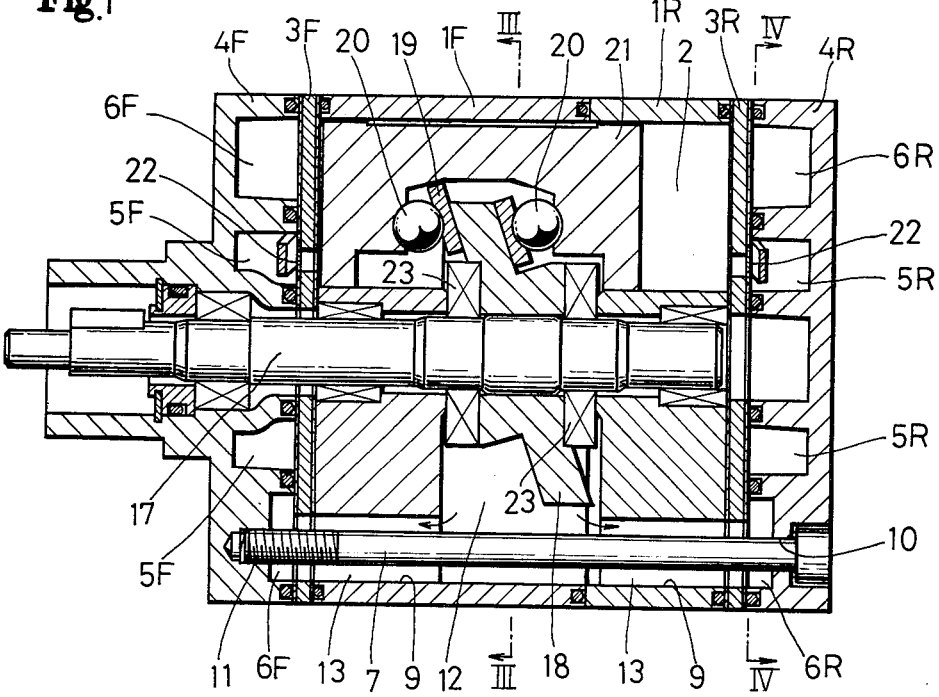
FIG. 1 is a longitudinal sectional view of a swash plate type compressor embodying this invention.

Referring now to the drawings, there is shown a swash plate type compressor having a cylinder block which is provided with as much as five bores, though the size of the cylinder block is no greater than that of a conventional cylinder block having at most three bores. The cylinder block which is made substantially cylindrical in external form may axially be divided into a front portion 1F and a rear portion 1R. Each of these cylinder block portions 1F and 1R possesses five bores 2 which are arranged at equal distances along the circumference thereof. In the cylinder block there is centrally formed a swash plate chamber 12 in which a swash plate 18 is rotatably fixed to a shaft 17 axially supported in the center of the cylinder block. A front housing 4F and a rear housing 4R are attached to the outer ends of the front and the rear cylinder block portions 1F and 1R through valve plates 3F and 3R, respectively. The front and the rear housings 4F and 4R are provided with depressed circular high pressure chambers 5F and 5R, respectively and also provided with circular low pressure chambers 6F and 6R around the high pressure chambers 5F and 5R, respectively.

In order to join the front and the rear cylinder block portions 1F and 1R, the valve plates 3F and 3R and the housings 4F and 4R altogether in the axial direction, there are inserted five clamping bolts 7 into bolt holes 10 made in the rear housing 4R which lead to through holes 9 perforated through narrow interzones 8 lying between every two adjacent bores 2 in each of the front and the rear cylinder block portions 1F and 1R. The tips of the bolts 7 are screwed into tapped holes 11 made in the front housing 4F, so that the above-mentioned members are tightly clamped altogether. Further, as is clear from FIG. 1, there is arranged a sealing packing or gasket between every two adjacent members in order to prevent the possible escape of the refrigerant gas.

Figure 2:
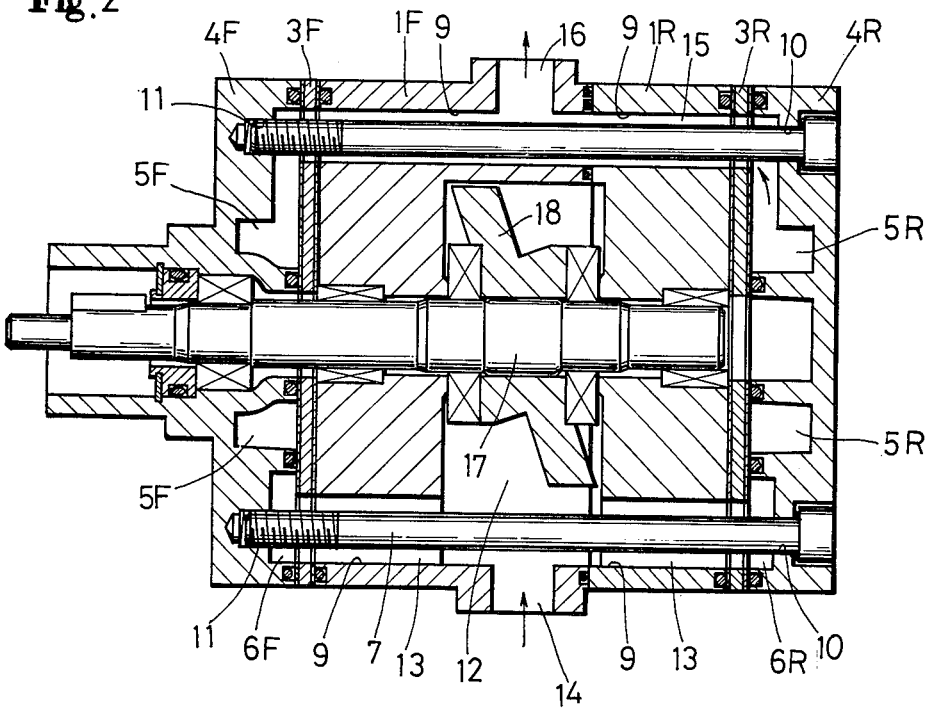
FIG. 2 is an another longitudinal sectional view of the swash plate type compressor.
Figure 3:
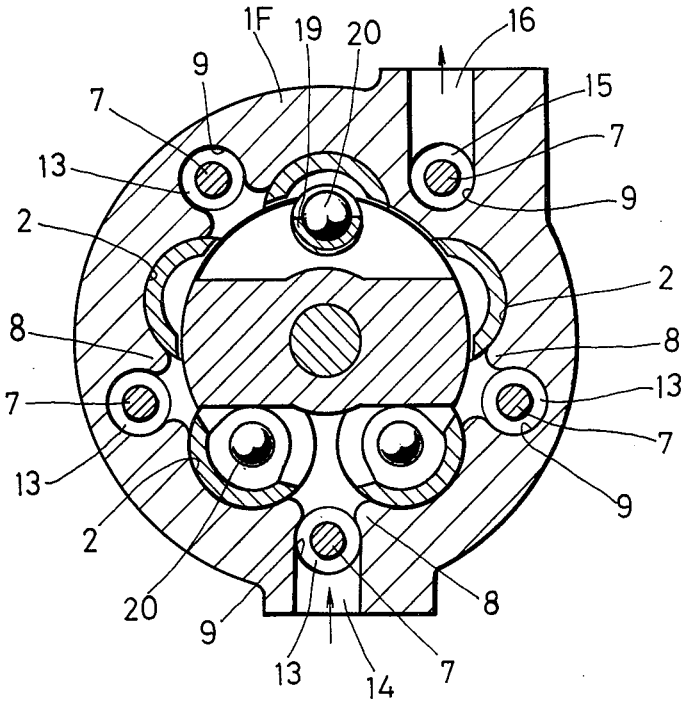
FIG. 3 is a sectional view taken along the line III—III of FIG. 1.
Figure 4:
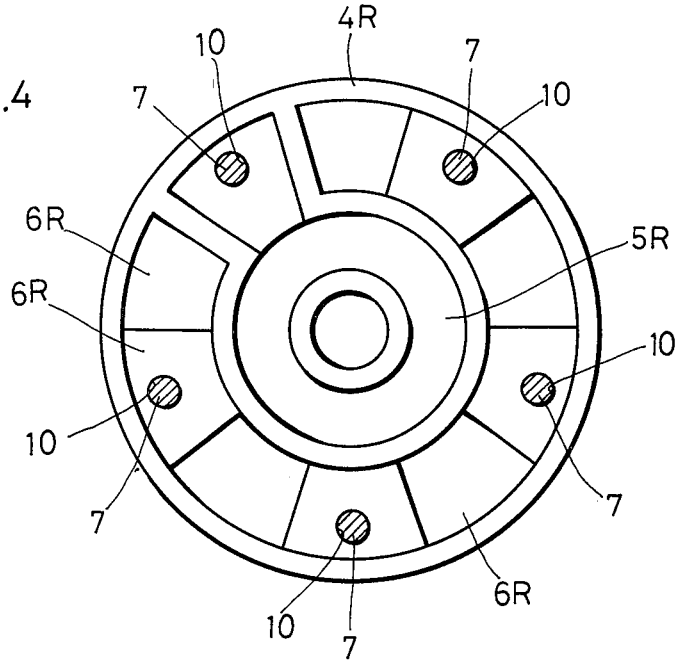
FIG. 4 is a sectional view taken along the line IV—IV of FIG. 1.

The diameter of each through hole 9 formed in the cylinder block is considerably greater than that of the clamping bolt 7, accordingly there is produced a space 13 between the exterior surface of the bolt 7 and the interior surface of the through hole 9. The spaces 13 in four of the five through holes 9 communicate with the swash plate chamber 12 in the cylinder block and lead to both of the front and rear low pressure chambers 6F and 6R of the front and rear housing 4F and 4R via holes made in the front and rear valve plates 3F and 3R, respectively, and these spaces 13 serve as refrigerant gas suction passages. Besides, as shown in FIG. 2, one of these four holes 9 is communicated with a refrigerant gas suction port 14 provided at the lower middle portion of the cylinder block. The remaining one of the five through holes 9 does not communicate with the swash plate chamber 12 but, as shown in FIG. 2, leads to both of the front and rear high pressure chambers 5F and 5R of the front and rear housings 4F and 4R via holes made in the front and rear valve plates 3F and 3R, respectively, so as to serve as a refrigerant gas outlet passage 15, and this hole 9 is communicated with a refrigerant gas outlet port 16 provided at the upper middle portion of the cylinder block. The front and the rear low pressure chambers 6F and 6R respectively formed in the front and the rear housings 4F and 4R are shallow in depth in the neighborhood of the bolt holes 10 or the tapped holes 11, but they are made at the other portions as deep as the high pressure chambers 5F and 5R so as to have the gas flow as smoothly as possible.

As described hereinbefore, the shaft 17, a part of which protrudes beyond the compressor body to be connected to an outside driving means (not shown), is rotatably supported in the center of the cylinder block. The swash plate 18 is carried on the shaft 17 together with a pair of thrust bearings 23 the outer surfaces of which are in contact with the inner surfaces of the front and the rear cylinder block portions 1F and 1R, respectively. On both inclined surfaces of the swash plate 18 there are provided shoes 19 which are slidable in the circumferential direction thereof, and balls 20 are rotatably carried on the shoes 19. The balls 20 are engaged with duplex head pistons 21 fitted in the bores 2, respectively, so that the duplex head pistons 21 may reciprocate within the bores 2 as the swash plate 18 rotates.

The operation of the embodiment constructed as described above will now be explained.

Each of the duplex head pistons 21 is reciprocated within one bore 2 as the shaft 17 as well as the swash plate 18 are rotated. During the reciprocal movement of the duplex head piston 21, the refrigerant gas is sucked into the swash plate chamber 12 via the middle portion of one of the through holes 9 from a refrigerant gas suction port 14 connected to an outside suction pipe (not shown) due to a negative pressure developed in the bore 2 upon retraction of the piston 21. The low pressure refrigerant gas sucked into the swash plate chamber 12 further flows into both of the front and the rear low pressure chambers 6F and 6R formed in the front and rear housings 4F and 4R by way of the refrigerant gas suction passages 13 formed in the holes 9 the middle portions of which are open to the swash plate chamber 12. Then the refrigerant gas is introduced into the bores 2 during the suction stroke via suction valves (not shown) provided in the inner sides of the valve plates 3F and 3R which may be opened by the negative pressure developed in the bores 2. During the compression stroke, the refrigerant gas is compressed by the pistons 21 in the bores 2 to be of high pressure, and the high pressure refrigerant gas pushes and open exhaust valves 22 attached to the outer sides of the valve plates 3F and 3R and flows into the front and rear substantially circular high pressure chambers 5F and 5R. Then the refrigerant gas passes through short passages radially outwardly extending from the high pressure chambers 5F and 5R into the outlet passage 15, and then flows out via the outlet port 16 to outside pipe (not shown).

During the cooling cycle, the high pressure refrigerant gas is liquefied by means of a condenser and is evaporated and expanded in an evaporator, so that the air in the vehicle may be cooled. After that, the refrigerant is sucked again into the suction port 14 in the form of low pressure gas.

Thus, in the swash plate type compressor according to this invention, the centrally located cylinder block and the housings at both sides thereof are joined by means of the clamping bolts inserted into the through holes perforated through narrow interzones lying between two adjacent bores formed in the cylinder block. As the space produced between the exterior surface of the clamping bolt and the interior surface of the through hole into which the clamping bolt is inserted serves as the refrigerant gas passage, the outside diameter of the compressor body may be reduced and on the other hand, the space necessary for forming bores in the cylinder block may substantially be increased, resulting in an increase in number of the bores. Accordingly, the cooling efficiency can be improved and the pulsation of the compressor body can be made uniform without making the compressor body larger in size. Further, this invention is advantageous over the prior arts in respect of the cooling of the compressor body and the lubrication within the swash plate chamber, since the swash plate chamber serves as a passage for the low pressure refrigerant gas and the refrigerant gas is dispersedly introduced into a plurality of bores. Furthermore, the bolt hole having a considerably larger diameter than the bolt does not require any substantial dimensional accuracy relative to the bolt, but is very easy to make.

What we claim is:

1. A substantially circular cylindrical swash plate type compressor comprising a cylinder block consisting of a front portion and a rear portion, each of said cylinder block portions being provided with a plurality of bores arranged at equal distances along its circumference; a swash plate chamber formed in said cylinder block in which a swash plate is rotatably fixed to a shaft, said swash plate chamber being connected to a refrigerant gas suction port provided at the middle portion of said cylinder block; a plurality of duplex head pistons which axially reciprocate in engagement with said swash plate in said swash plate chamber, said duplex head pistons being fitted in said cylinder block; and a front and a rear housing respectively attached to the front and rear ends of said cylinder block through a front and a rear valve plate, respectively, each of said front and rear housings having a low pressure gas chamber as well as a high pressure gas chamber which may communicate with said bores of said cylinder block; wherein between each two circumferentially adjacent bores of said cylinder block there is provided a through hole into which a clamping bolt is inserted, each through hole, for the length thereof, being greater in size than the diameter of said clamping bolt and providing a full length space which serves as a refrigerant gas passage parallel to said bores, a refrigerant gas outlet port provided at the middle portion of said cylinder block, at least one of said through holes being fluidly connected with said front and rear high pressure gas chambers formed in said front and rear housings and the refrigerant gas outlet port, and the other through holes being fluidly connected with said centrally located swash plate chamber and said low pressure gas chambers of both housings.

2. A swash plate type compressor according to claim 1 wherein five bores and five duplex head pistons are provided.

3. A swash plate type compressor according to claim 2 wherein said through holes are circular in cross section and said at least one through hole is independent of said swash plate chamber.

4. A swash plate type compressor according to claim 2 wherein said low pressure gas chamber is substantially circularly formed adjacent to the circumferential surface of said housing and is fluidly connected with each of said through holes which serve as the refrigerant gas suction passages.

5. A swash plate type compressor according to claim 2 wherein said high pressure gas chamber is substantially circularly formed near the center of said housing and is fluidly connected with one of said at least one through hole which serves as an outlet passage of the refrigerant gas by way of a short passage radially outwardly extending from a part of said high pressure chamber.

* * * * *